US006245288B1

(12) United States Patent
Carroll

(10) Patent No.: US 6,245,288 B1
(45) **Date of Patent: *Jun. 12, 2001**

(54) METHOD OF PREPARING PRESSABLE POWDERS OF A TRANSITION METAL CARBIDE, IRON GROUP METAL OF MIXTURES THEREOF

(75) Inventor: Daniel F. Carroll, Midland, MI (US)

(73) Assignee: OMG Americas, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/494,454

(22) Filed: Jan. 31, 2000

(30) Foreign Application Priority Data

Mar. 26, 1999 (WO) ..... PCT/US99/06689

(51) Int. Cl.[7] ..... B22F 1/00

(52) U.S. Cl. ..... 419/34; 419/37; 419/17; 419/18

(58) Field of Search ..... 419/34, 37, 17, 419/18

(56) References Cited

U.S. PATENT DOCUMENTS 5,540,981 * 7/1996 Gallagher et al. ..... 428/220
5,922,978 * 7/1999 Carroll ..... 75/240

* cited by examiner

*Primary Examiner*—Daniel Jenkins
(74) *Attorney, Agent, or Firm*—Kalow & Springut LLP; John J. Santalone, Esq.

(57) ABSTRACT

A pressable powder is formed by a method comprising [I] mixing, in essentially deoxygenated water, [A] a first powder selected from the group consisting of a transition metal carbide and transition metal with [B] an additional component selected from the group consisting of (i) a second powder comprised of a transition metal carbide, transition metal or mixture thereof; (ii) an organic binder and (iii) combination thereof and [II] drying the mixed mixture to form the pressable powder, wherein the second powder is chemically different than the first powder. The pressable powder may then be formed into a shaped part and subsequently densified into a densified part, such as a cemented tungsten carbide.

12 Claims, No Drawings

METHOD OF PREPARING PRESSABLE POWDERS OF A TRANSITION METAL CARBIDE, IRON GROUP METAL OF MIXTURES THEREOF

This application claims priority from PCT PCT/US99/06689 with a filing date of Mar. 26, 1999.

FIELD OF THE INVENTION

The invention relates to pressable powders of transition metal carbides, iron group metals or mixtures thereof. In particular, the invention relates to pressable powders of WC mixed with Co.

BACKGROUND OF THE INVENTION

Generally, cemented tungsten carbide parts are made from powders of WC and Co mixed with an organic binder, such as wax, which are subsequently pressed and sintered. The binder is added to facilitate, for example, the flowability and cohesiveness of a part formed from the powders. To ensure a homogeneous mixture, the WC, Co and binder are typically mixed (e.g., ball or attritor milled) in a liquid. The liquid is generally a flammable solvent, such as heptane, to decrease the tendency for the WC to decarburize and for the WC and Co to pick up oxygen, for example, when mixed in water or air. The decarburization of the WC and introduction of excessive oxygen must be avoided because undesirable phases in the cemented carbide tend to occur, generally causing reduced strength.

Unfortunately, the use of a flammable solvent requires significant safety, environment and health precautions, resulting in a significant amount of cost to produce the pressable powder. To avoid some of these problems, WC particles greater than about 1 micrometer in diameter with cobalt and binders have been mixed or milled in water (U.S. Pat. Nos. 4,070,184; 4,397,889 4,478,888; 4,886,638; 4,902,471; 5,007,957 and 5,045,277). Almost all of these methods require the mixing of the WC powders with just the organic binder and, subsequently, heating the mixture until the binder melts and coats all of the WC particles before milling with Co in water.

Smaller WC particles (e.g., less than 0.5 micrometer in diameter) are now being used to increase the strength and hardness of cemented tungsten carbide parts. However, because of the increased specific surface area ($m^2/g$) of these WC powders, the avoidance of oxygen pickup has become more difficult. Consequently, the use of these smaller particles has tended to require the milling time to be longer to ensure a uniform mixture of WC with Co, exacerbating the problem of oxygen pick up. Because of these problems, these small powders, generally, are always processed in a solvent, such as heptane.

Thus, it would be desirable to provide a method to form a pressable powder that avoids one or more of the problems of the prior art, such as one or more of those described above.

SUMMARY OF THE INVENTION

A first aspect of the invention is a method to prepare a pressable powder, the method comprises mixing, in essentially deoxygenated water, a first powder selected from the group consisting of a transition metal carbide and transition metal with an additional component selected from the group consisting of (i) a second powder comprised of a transition metal carbide, transition metal or mixture thereof; (ii) an organic binder and (iii) combination thereof and drying the mixed mixture to form the pressable powder, wherein the second powder is chemically different than the first powder. Herein, chemically different is when the first powder has a different chemistry. Illustrative examples include mixes of (1) WC with W, (2) WC with Co, (3) WC with VC, (4) WC with $W_2C$, (5) WC with $Cr_3C_2$ and (6) Co with Ni.

A second aspect is a pressable powder made by the method of the first aspect. A final aspect is a densified body made from the pressable powder of the second aspect.

Surprisingly, it has been discovered that by mixing in essentially deoxygenated water, a transition metal carbide (e.g., WC), transition metal (e.g., Ni, Co, and Fe) and mixtures thereof may be mixed for long times and still not pick up any more oxygen than when mixing, for example, in heptane. Consequently, the densified shaped part of this invention may have the same properties as those made from powder mixed in heptane without any further processing or manipulations (e.g., addition of carbon in WC-Co systems). This has been evident even when using submicron WC powders, Co or mixtures thereof.

DETAILED DESCRIPTION OF THE INVENTION

The method comprises mixing of a first powder with an additional component in essentially deoxygenated water. In performing the method, it is critical that the water is essentially deoxygenated so as to avoid oxygen pick up during the milling. Herein, essentially deoxygenated water corresponds to an amount of dissolved oxygen in the water of at most about 2.0 mlligrams/liter (mg/L). Preferably the amount of dissolved oxygen is at most about 1 mg/L, more preferably at most about 0.5 mg/L, even more preferably at most about 0.1 mg/L and most preferably at most about 0.05 mg/L. A suitable amount of dissolved oxygen is also when the amount of dissolved oxygen is below the detection limit of Corning Model 312 Dissolved Oxygen Meter (Corning Inc., Scientific Div., Corning, N.Y.).

The water generally is deoxygenated, prior to mixing, by (i) addition of a deoxygenating compound, (ii) bubbling of a gas essentially free of oxygen through the water or (iii) combination thereof. Preferably the water is deoxygenated by bubbling gas essentially free of oxygen through the water so as to minimize any adverse effects the deoxygenating compound may have, for example, on the densification of a shaped part made from the pressable powder. Examples of suitable gases include nitrogen, hydrogen, helium, neon, argon, krypton, xenon, radon or mixtures thereof. More preferably the gas is argon or nitrogen. Most preferably the gas is nitrogen. Examples of useful deoxygenating compounds, when used, include those described in U.S. Pat. Nos. 4,269,717; 5,384,050; 5,512,243 and 5,167,835, each incorporated herein by reference. Preferred deoxygenating compounds include hydrazine and carbohydrazides (available under the Trademark ELIMIN-OX, Nalco Chemical Company, Naperville, Ill.).

The essentially deoxygenated water is preferably formed using distilled and deionized water and more preferably the water is high purity liquid chromatography (HPLC) grade water, available from Fisher Scientific, Pittsburgh, Pa. The pH of the water may be any pH but preferably the pH is basic. More preferably the pH of the water is at least 8 to at most 10. The pH may be changed by addition of an inorganic acid or base, such as nitric acid or ammonia.

The first powder is either a transition metal carbide or transition metal powder. When the first powder is a transition metal carbide it may be any transition metal carbide but preferably the first powder is a carbide of titanium, vanadium, chromium, zirconium, niobium, molybdenum, hafnium, tantalum, tungsten or mixtures thereof. Most preferably the first powder is tungsten carbide.

When the first powder is a transition metal it may be any transition metal but preferably is manganese, iron, cobalt, nickel, copper, molybdenum, tantalum, tungsten, rhenium or mixtures thereof. More preferably the first powder is iron, cobalt, nickel or mixtures thereof. Most preferably the first powder is cobalt.

The first powder may be any size useful in making a densified part by powder metallurgical methods. However, the average particle size of the first powder is preferably at most about 25 micrometers, more preferably at most about 10 micrometers, even more preferably at most about 1 micrometer and most preferably at most about 0.5 micrometer to greater than 0.001 micrometer.

The first powder is mixed with an additional component selected from the group consisting of (i) a second powder comprised of a transition metal carbide, transition metal or mixture thereof; (ii) an organic binder and (iii) combination thereof, provided that when the second component is comprised of a second powder the second powder is chemically different, as previously described.

When present, the second powder may be comprised of any transition metal carbide but preferably the transition metal carbide is one of the preferred carbides previously described for the first powder. When present, the second powder may be comprised of any transition metal but preferably the transition metal is one of the preferred transition metals previously described for the first powder. The second powder, when present, may be any size useful in making a densified body by powder metallurgical methods but preferably the size is similar to the preferred sizes described for the first powder.

In a preferred embodiment, the first powder is a transition metal carbide and the second powder is a transition metal. In this embodiment, the transition metal carbide generally is present in an amount of about 99 percent to 10 percent by weight of the total weight of the first and second powders. More preferably the powder to be mixed (i.e., first and second powders) is a mixture of one of the preferred transition metal carbides described above and iron, cobalt, nickel or mixture thereof. Even more preferably this to-be-milled powder is a mixture of at least one of the preferred transition metal carbides and cobalt. In a more preferred embodiment, this to-be-milled powder is comprised of WC and Co. In an even more preferred embodiment, the to-be-milled powder is comprised of submicron WC and Co. In a most preferred embodiment, this powder is comprised of submicron WC and submicron Co.

When present, the organic binder may be any organic binder suitable for enhancing the binding of the pressable powder after compacting in a die compared to powders devoid of any organic binder. The binder may be one known in the art, such as wax, polyolefin (e.g., polyethylene), polyester, polyglycol, polyethylene glycol, starch and cellulose. Preferably the organic binder is a wax that is insoluble in water. Preferred binders include polyethylene glycol having an average molecular weight of 400 to 4600, polyethylene wax having an average molecular weight of 500 to 2000, paraffin wax, microwax and mixtures thereof. Generally, the amount of organic binder is about 0.1 to about 10 percent by weight of the total weight of the powder and organic binder.

When the organic binder is a water insoluble organic binder (e.g., paraffin wax, microwax or mixture thereof), it is preferred that the binder is either emulsified in the deoxygenated water prior to mixing with the powder or is added as a binder in water emulsion. The water of the emulsion may contain a small amount of dissolved oxygen, as long as the total dissolved oxygen of the deoxygenated water does not exceed the amount previously described. Preferably the amount of dissolved oxygen of the water of the emulsion is the same or less than the amount present in the essentially deoxygenated water.

In a most preferred embodiment, the method comprises mixing, in essentially deoxygenated water, WC powder, Co and the organic binder described above. The WC preferably has a submicron particle size. The Co preferably has a submicron particle size. The organic binder is preferably a paraffin wax. More preferably the organic binder is a paraffin wax provided as an emulsion in water.

Depending on the first powder and additional component, a corrosion inhibitor, such as those known in the art (e.g., corrosion inhibitors useful in the boiler, machining and heat exchanger art), may be used. If added, the corrosion inhibitor should be one that does not, for example, hinder the densification of a part pressed from the pressable powder. Preferably the corrosion inhibitor does not contain an alkali metal, alkaline earth metal, halogen, sulfur or phosphorous. Examples of corrosion inhibitors include those described in U.S. Pat. Nos. 3,425,954; 3,985,503; 4,202,796; 5,316,573; 4,184,991; 3,895,170 and 4,315,889. Preferred corrosion inhibitors include benzotriazole and triethanolamine, The mixing may be performed by any suitable method, such as those known in the art. Examples include milling with milling media, milling with a colloid mill, mixing with ultrasonic agitation, mixing with a high shear paddle mixer or combinations thereof. Preferably the mixing is performed by mining with milling media, such as ball milling and attritor milling. When milling with milling media, the media preferably does not add contaminates in an amount that causes, for example, inhibition of the densification of a shaped part made from the pressable powder. For example, it is preferred that cemented tungsten carbide-cobalt media is used when milling powders comprised of WC and Co.

When mixing, the first powder and additional component may be added to the deoxygenated water in any convenient sequence. For example, the organic binder may first be coated on the first powder particles as described in U.S. Pat. Nos. 4,397,889; 4,478,888; 4,886,638; 4,902,471; 5,007,957 and 5,045,277, each incorporated herein by reference. Preferably the organic binder and the powder to be mixed (e.g., first powder or first powder and second powder) are added separately to the deoxygenated water.

The amount of water used when mixing generally is an amount that results in a slurry having about 5 percent to about 50 percent by volume solids (e.g., powder or powders and organic binder). The mixing time may be any time sufficient to form a homogeneous mixture of the powder and organic binder. Generally, the mixing time is from about 1 hour to several days.

After milling, the slurry is dried to form the pressable powder. The slurry may be dried by any suitable technique, such as those known in the art. Preferred methods include spray drying, freeze drying, roto-vapping and pan roasting. More preferably the method of drying is spray drying. Drying is preferably performed under a non-oxidizing atmosphere, such as an oxygen free gas (e.g., nitrogen, argon, helium or mixtures thereof) or vacuum. Preferably the atmosphere is nitrogen. The temperature of drying is generally a temperature where the organic binder does not, for example, excessively volatilize or decompose. The drying time may be any length of time adequate to dry the powder sufficiently to allow the powder to be pressed into a shaped part.

The pressable powder may then be formed into a shaped body by a known shaping technique, such as uniaxial pressing, roll pressing and isostatic pressing. The shaped part then may be debindered by a suitable technique, such as those known in the art and, subsequently, densified by a suitable technique, such as those known in the art to form the densified body. Examples of debindering include heating under vacuum and inert atmospheres to a temperature sufficient to volatilize or decompose essentially all of the organic binder from the shaped part. Examples of densification techniques include pressureless sintering, hot pressing, hot isostatic pressing, rapid omni directional compaction, vacuum sintering and explosive compaction.

The densified shaped body, generally, has a density of at least about 90 percent of theoretical density. More preferably the densified shaped body has a density of at least about, 98 percent, and most preferably at least about 99 percent of theoretical density.

Below are specific examples within the scope of the invention and comparative examples. The specific examples are for illustrative purposes only and in no way limit the invention described herein.

EXAMPLES

Example 1

First, nitrogen is bubbled through about 1 liter of HPLC water, which has a resistance of 18 mega-ohms and dissolved oxygen concentration of about 8.0 mg/L, for about 24 hours to form deoxygenated water having a dissolved oxygen concentration of zero, as measured by a Corning Model 312 Dissolved Oxygen Monitor (Corning Inc., Science Products Div., Corning, N.Y.). Then, 50 grams of Dow Superfine WC (The Dow Chemical Co., Midland Mich.) and 5.6 grams of Starck extra fine grade cobalt powder (H.C. Starck Co., Cobalt Metal Powder II-Extra Fine Grade, Goslar, Germany) are mixed by hand with 50 mL of the deoxygenated water to form a slurry. The Dow Superfine WC powder has a surface area of 1.8 $m^2/g$, carbon content of 6.09 percent by weight and oxygen content of 0.29 percent by weight. The cobalt powder has an average particle size of 1.1 micrometer and oxygen content of 1.06 percent by weight. The oxygen content of 50 grams of WC combined with 5.6 grams of cobalt, prior to mixing in the water, is 0.36 percent by weight. The slurry is periodically stirred for 24 hours. Then, the water is dried at 40° C. under a flowing nitrogen atmosphere. The oxygen content of this dried mixed powder is 0.44 percent by weight (see Table 1).

The oxygen content is measured with a "LECO" TC-136 oxygen determinator.

Example 2

A slurry is made and dried using the same procedure as described in Example 1, except that an amount of benzotriazole (Aldrich Chemical Company Inc., Milwaukee, Wis.) was added to the 50 mL of deoxygenated water to provide a 0.02M (molar) solution of the benzotriazole. The oxygen content of the dried mixed powder is shown in Table 1.

Comparative Example 1

A slurry is made and dried by the same procedure described in Example 1, except that instead of using deoxygenated water, heptane is used. The oxygen content of the dried mixed powder is shown in Table 1.

Comparative Example 2

A slurry is made and dried by the same procedure described in Example 1, except that instead of using deoxygenated water, the HLPC is used as is (i.e., not deoxygenated). The HLPC water as -s contains about 8 mg/L of dissolved oxygen. The oxygen content of the dried mixed powder is shown in Table 1.

Comparative Example 3

A slurry is made and dried by the same procedure described in Example 2, except that instead of using deoxygenated water the HLPC is used as is. The oxygen 25 content of the dried mixed powder is shown in Table 1.

Example 1 compared to Comparative Example 2 shows that deoxygenated water decreases the pick up of oxygen of WC and Co powder mixed in water compared to powder mixed in water containing oxygen. This is the case even when these powders are mixed in oxygenated water containing benzotriazole (Example 1 versus Comparative Example 3). Finally, Example 2 compared to Comparative Example 1 shows that these powders, when mixed in deoxygenated water containing benzotiazole (i.e., corrosion inhibitor), can result in no pick up or the same oxygen pick up as these powders mixed in heptane.

TABLE 1

Processing Conditions and Oxygen Content of Mixed Powders

| Example | Milling Liquid | Benzotriazole Addition | Oxygen Content of Dried Powder (% by weight) |
|---|---|---|---|
| Example 1 | Deoxygenated HPLC water | NO | 0.44 |
| Example 2 | Deoxygenated HPLC water | YES | 0.37 |
| Comparative Ex. 1 | Heptane | NO | 0.37 |
| Comparative Ex. 2 | HPLC water | NO | 0.51 |
| Comparative Ex. 3 | HPLC water | YES | 0.46 |

Example 3

Within a nitrogen atmosphere, 93.5 parts by weight (pbw) of Dow Superfine WC powder, 6 pbw of Starck Extra Fine Grade Co, 0.5 pbw of vandium carbide (Trintech International Inc., Twinsberg, Ohio), and a paraffin wax emulsion to yield 1 pbw of paraffin wax (Hydrocer EP91 emulsion, Shamrock Technologies, Inc. Newark, N.J.) are placed into a stainless steel ball mill half filled with spherical 3/16" diameter cemented tungsten carbide media. An amount of deoxygenated water, as described in Example 1, is added to form a slurry having a solids concentration of about 8 percent by volume. The slurry is ball milled for about 24 hours. The slurry is separated from the milling media by passing through a 325 mesh sieve and then the slurry is dried under nitrogen at 100° C. for about 18 hours. After drying, the powder is passed through a 60 mesh sieve to form a pressable powder.

About 15 grams of the pressable powder are pressed in a 0.75 inch diameter uniaxial die at 22,000 pounds per square inch to form a 0.75 inch diameter by about 0.3 inch thick shaped body. The shaped body is sintered at 1380° C. for 1 hour under vacuum to form a shaped densified body. The properties of the densified shaped body are shown in Table 2.

Example 4

A pressable powder, shaped body and densified shaped body are made by the same method described by Example 3, except that 0.6 pbw of benzotriazole is added to the slurry. The properties of the densified shaped body are shown in Table 2.

Comparative Example 4

A pressable powder, shaped body and densified shaped body are made by the same method described by Example 3, except that instead of using the HLPC deoxygenated water, the HPLC is used as is (i.e., not deoxygenated). The properties of the densified shaped body are shown in Table 2.

Comparative Example 5

A pressable powder, shaped body and densified shaped body are made by the same method described by Example 4, except that instead of using the HPLC deoxygenated water, the HLPC is used as is (i.e., not deoxygenated). The properties of the densified shaped body are shown in Table 2.

TABLE 2

Processing Conditions and properties of Densified Shaped Bodies

| | Type of Water | | Benzotriazole | Paraffin | Magnetic |
|---|---|---|---|---|---|
| Example | HPLC Water | De-oxygenated HPLC Water | Addition (pbw) | Emulsion* (pbw) | Saturation (emu/g) |
| Example 3 | | X | 0.00 | 1.00 | 138 |
| Example 4 | | X | 0.593 | 1.00 | 139 |
| Comp. Ex. 4 | X | | 0.593 | 1.00 | 120 |
| Comp. Ex. 5 | X | | 0.0 | 1.00 | 117 |

*Hydrocer EP 91 emulsion, Shamrock Technologies, Inc., Newark, NJ

Generally, an acceptable magnetic saturation of a WC/Co cemented carbide densified body processed with heptane and sintered under the same conditions as the Examples and Comparative Examples of Table 2 ranges from about 135–151 emu/g. A magnetic saturation in this range indicates that the sintered WC/Co body has a proper carbon balance and should exhibit the most desirable mechanical properties. Lower saturations indicate the WC/Co is deficient in carbon and will tend to have inferior mechanical properties. Thus, Examples 3 and 4 show that the use of deoxygenated water, with and without a corrosion inhibitor, results in WC/Co densified bodies having properties equivalent to those processed using heptane. Whereas, bodies processed in water containing oxygen result in densified WC/Co cemented carbide bodies deficient in carbon (Comparative Examples 4 and 5).

The following examples show the utility of the disclosed invention for processing cobalt powder metals in an aqueous environment using de-oxygenated water and a benzotriazole corrosion inhibitor.

Example 5

5.6 grams of Starck Extra Fine Grade cobalt powder with a nominal oxygen content of about 1.0 wt. % (as measured by a "LECO" TC-136 oxygen determinator) was mixed in 50 cc of HLPC water (which had a resistance of 18 M-ohms and a dissolved oxygen content of about 8.0 mg/L) and then periodically stirred over a period of 24 hours. The powder mixture was then dried at 40° C. in a flowing nitrogen atmosphere. The oxygen content of the dried powder was then measured by the LECO analyzer to be 2.10 wt. %. This increase in oxygen content is due to a reaction between the cobalt and the aqueous environment. For applications that require water processing, this amount of oxygen pick-up by the cobalt is undesirable.

Example 6

A cobalt powder in water mixture was prepared following the procedures in Example 5 except that a deoxygenated HPLC water (having a resistance of 18 M-ohms and a dissolved oxygen content of about 0 mg/L) was used. The HPLC water was de-oxygenated by bubbling nitrogen gas through the water for a period of 24 hours. After drying the powder mixture according to Example 5, the residual oxygen content was measured to be about 1.75 wt. % by the LECO analyzer. Comparing this result to Example 5, the amount of oxygen pick-up by the cobalt is reduced by removing the dissolved oxygen from the aqueous environment.

Example 7

A cobalt powder in water mixture was prepared following the procedures in Example 6 except that an amount of benzotriazole corrosion inhibitor was added to the de-oxygenated water, prior to the addition of the cobalt, to provide a 0.02 M solution of the benzotriazole. After drying the powder mixture according to Example 5, the residual oxygen content of the cobalt was 0.94 wt. %. This result indicates that the combination of de-oxygenate water and benzotriazole enables cobalt to be processed in an aqueous environment without any oxygen pick-up.

Example 8

A granulated, waxed cobalt powder was prepared by spray-drying an aqueous slurry containing cobalt, de-oxygenated water, benzotriazole and paraffin wax. The cobalt slurry was prepared by the following method: 1) the HPLC water was de-oxygenated by bubbling nitrogen gas through the water, 2) the benzotriazole corrosion inhibitor was added to the HPLC water and then mechanically stirred, 3) the temperature of the water solution was raised above the melting temperature of the wax, 4) the paraffin wax was added to the water solution and mixed aggressively, 5) enough cobalt powder (oxygen content of about 0.2 wt. % as measured by the Thermo Gravametric Analysis (TGA) method) was added to bring the solids loading up to about 70 wt. %. The amount of benzotriazole corrosion inhibitor and paraffin wax used in this mixture corresponded to a 0.3 wt. % and 2.0 wt. % addition, respectively, based upon the amount of cobalt in the slurry. The temperature of the cobalt slurry was reduced below the melting temperature of the wax. The slurry was then spray-dried to form a granulated, flowable cobalt product. The oxygen content of the aqueous spray-dried cobalt powder was on the order of 0.3 wt. % (as measured by the TGA method). The granulated, flowable cobalt product had an additional characteristic in that the amount of dust created during powder handling was significantly reduced as compared to the starting cobalt powder.

What is claimed is:

1. A method to prepare a pressable powder, the method comprises [I] mixing, in essentially deoxygenated water, [A] a cobalt powder with [B] an organic binder and [II] drying the mixed mixture to form the pressable powder.

2. The method of claim 1 wherein a corrosion inhibitor is added to the deoxygenated water.

3. The method of claim 2 wherein the corrosion inhibitor is benzotriazole or triethanolamine.

4. The method of claim 1 wherein the cobalt powder is submicron.

5. The method of claim 1 wherein the organic binder is a wax.

6. The method of claim 5 wherein the wax is paraffin wax.

7. The method of claim 3 wherein the organic binder is a wax.

8. The method of claim 1 wherein the drying comprises spray drying.

9. A pressable powder prepared by the method of claim 1.

10. A densified shaped body prepared by the method of claim 1.

11. A method to prepare a pressable powder, the method comprising: 1) mixing, in essentially deoxygenated water, (a) a transition metal carbide powder selected from the group consisting of titanium, vanadium, chromium, molybdenum, tantalum, tungsten or mixtures thereof with (b) a submicron cobalt powder and; 2) drying the mixture to form the pressable powder.

12. The method of claim 11 wherein the powder metal is submicron cobalt.

* * * * *

UNITED STATES PATENT AND TRADEMARK OFFICE

CERTIFICATE OF CORRECTION

PATENT NO. : 6,245,288 B1
DATED : June 12, 2001
INVENTOR(S) : Carroll

It is certified that error appears in the above-identified patent and that said Letters Patent is hereby corrected as shown below:

Title page,
Line 3, now reads "Group Metal Of", should read -- Group Metal Or --.

Column 4,
Line 36, now reads "by mining with", should read -- by milling with --.

Signed and Sealed this

Fifteenth Day of January, 2002

*Attest:*

JAMES E. ROGAN